US008666266B2

(12) United States Patent
Ajima

(10) Patent No.: US 8,666,266 B2
(45) Date of Patent: Mar. 4, 2014

(54) IMAGE FORMING APPARATUS AND IMAGE FORMING METHOD USING A CONTROLLED TONER SUPPLY OPERATION

(75) Inventor: Hisanobu Ajima, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 279 days.

(21) Appl. No.: 13/040,628

(22) Filed: Mar. 4, 2011

(65) Prior Publication Data

US 2011/0262154 A1 Oct. 27, 2011

Related U.S. Application Data

(60) Provisional application No. 61/327,879, filed on Apr. 26, 2010.

(51) Int. Cl.
*G03G 15/08* (2006.01)

(52) U.S. Cl.
USPC ..... 399/27

(58) Field of Classification Search
USPC ..... 399/27, 30, 61–64, 258, 81
See application file for complete search history.

(56) References Cited

U.S. PATENT DOCUMENTS

| | | | | |
|---|---|---|---|---|
| 5,826,134 | A * | 10/1998 | Hino et al. | 399/27 |
| 6,640,060 | B2 | 10/2003 | Yamaguchi et al. | |
| 6,687,467 | B2 * | 2/2004 | Katoh | 399/30 |
| 7,103,291 | B2 * | 9/2006 | Odani | 399/27 |
| 7,236,725 | B2 | 6/2007 | Inukai et al. | |
| 7,269,364 | B2 * | 9/2007 | Tanaka et al. | 399/27 |
| 7,352,977 | B2 * | 4/2008 | Nakano et al. | 399/30 |
| 7,415,214 | B2 * | 8/2008 | Sakita et al. | 399/27 |
| 7,440,802 | B2 | 10/2008 | Stahmann et al. | |
| 2004/0223773 | A1 * | 11/2004 | Ito et al. | 399/24 |
| 2005/0265738 | A1 | 12/2005 | Ogata | |
| 2006/0204252 | A1 | 9/2006 | Koichi | |

FOREIGN PATENT DOCUMENTS

| | | | |
|---|---|---|---|
| CN | 1831798 | | 9/2006 |
| JP | 06138768 | A * | 5/1994 |
| JP | 2000338767 | A * | 12/2000 |
| JP | 2009294487 | A * | 12/2009 |

OTHER PUBLICATIONS

Office Action for Chinese Patent Application No. 201110062606.4 Dated Jul. 7, 2012, 5 pgs.
Office Action for Chinese Patent Application No. 201110062606.4 Dated Jul. 13, 2012, 5 pgs.

* cited by examiner

*Primary Examiner* — Robert Beatty
(74) *Attorney, Agent, or Firm* — Turocy & Watson, LLP

(57) ABSTRACT

An image forming apparatus includes an image forming unit including a developing device, a toner cartridge to supply toner to the developing device, a toner remaining amount sensor to detect a toner remaining amount in the developing device, a toner use amount detection mechanism to detect a parameter value for obtaining a use amount of toner, a first memory which is provided in the toner cartridge and to which a threshold of the parameter indicating a near empty state is previously inputted, and a control mechanism which determines necessity of a forcible toner supply operation based on a comparison between the detected parameter value and the threshold, and the toner remaining amount detected by the toner remaining amount sensor, and controls the image forming unit.

10 Claims, 5 Drawing Sheets

FIG. 4

| MEMORY AT MAGE FORMING UNIT SIDE | |
|---|---|
| ADDRESS | INFORMATION CONTENT |
| A001 | IDENTIFICATION CODE |
| A002 | NEAR EMPTY THRESHOLD WRITING AREA |
| A003 | COUNTER VALUE WRITING AREA |

FIG. 5

| MEMORY AT TONER CARTRIDGE SIDE | |
|---|---|
| ADDRESS | INFORMATION CONTENT |
| B001 | IDENTIFICATION CODE |
| B002 | NEAR EMPTY THRESHOLD |
| B003 | COUNTER VALUE WRITING AREA |
| B004 | EMPTY INFORMATION WRITING AREA (1) |
| B005 | EMPTY INFORMATION WRITING AREA (2) |
| B006 | EMPTY INFORMATION WRITING AREA (3) |

FIG. 7

| No. | EMPTY INFORMATION | | | IMAGE FORMING UNIT MESSAGE DISPLAY | | IMAGE FORMING UNIT OPERATION | |
|---|---|---|---|---|---|---|---|
| | B004 | B005 | B006 | NEAR EMPTY SIGN | TONER REPLACEMENT SIGN | TONER FORCIBLE SUPPLY OPERATION | PRINT OPERATION |
| 1 | - | - | - | - | - | - | - |
| 2 | - | EXIST | - | - | DISPLAYED | - | - |
| 3 | - | - | EXIST | - | DISPLAYED | - | - |
| 4 | - | EXIST | EXIST | - | DISPLAYED | - | - |
| 5 | EXIST | - | - | DISPLAYED | - | - | - |
| 6 | EXIST | EXIST | - | DISPLAYED | DISPLAYED | STOP | - |
| 7 | EXIST | - | EXIST | DISPLAYED | DISPLAYED | STOP | STOP |
| 8 | EXIST | EXIST | EXIST | - | DISPLAYED | STOP | STOP |

FIG. 8

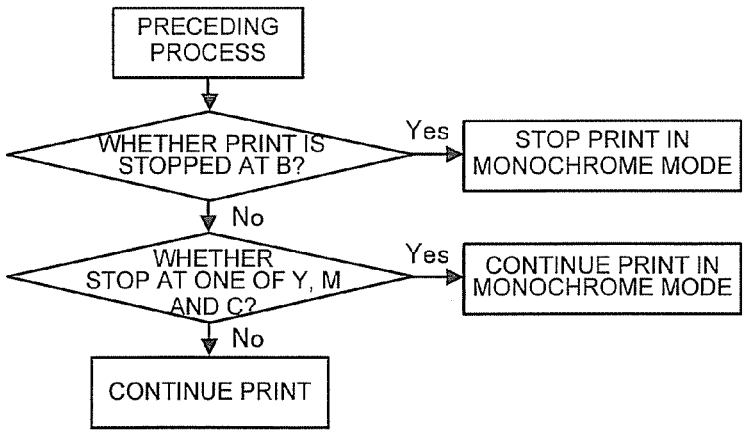

IMAGE FORMING APPARATUS AND IMAGE FORMING METHOD USING A CONTROLLED TONER SUPPLY OPERATION

CROSS-REFERENCE TO RELATED APPLICATION

This application is based upon and claims the benefit of priority from the prior U.S. Patent Application No. 61/327,879 filed on Apr. 26, 2010, the entire contents of which are incorporated herein by reference.

FIELD

Embodiments described herein relate generally to an image forming apparatus and an image forming method.

BACKGROUND

Generally, in an image forming apparatus of an electrophotographic system, a toner remaining amount sensor is disposed in a developing device. The toner remaining amount sensor obtains toner empty information in the developing device, and when toner empty becomes definite, forcible toner supply from a toner cartridge is performed at the time of warm-up after power-on.

Accordingly, when the toner empty in the developing unit becomes definite, also when power is turned OFF in the state where the toner cartridge has no toner and the toner cartridge is not replaced, the forcible toner supply is performed, and the life of a photoreceptor is reduced by the unnecessary supply operation. Besides, also at the time of return from a sleep mode (power-saving mode), since the forcible toner supply is performed again, a print operation is stopped by the unnecessary supply operation, and the user is required to wait before operating.

BRIEF DESCRIPTION OF THE DRAWINGS

FIG. 4 is a table showing a correspondence of an address and information content in the memory at the body side shows of the embodiment;

FIG. 5 is a table showing a correspondence of an address and information content in the memory 30 at the toner cartridge side of the embodiment;

FIG. 7 is a table showing a correspondence of the combination pattern empty information the composition and the message or the operation of the image forming apparatus;

FIG. 8 is a flowchart of a state of each of the image forming units in the four-drum tandem color printer and the operation of the image forming apparatus.

DETAILED DESCRIPTION

Reference will now be made in detail to the present embodiment of the invention, an example of which is illustrated in the accompanying drawing.

Figure 1:
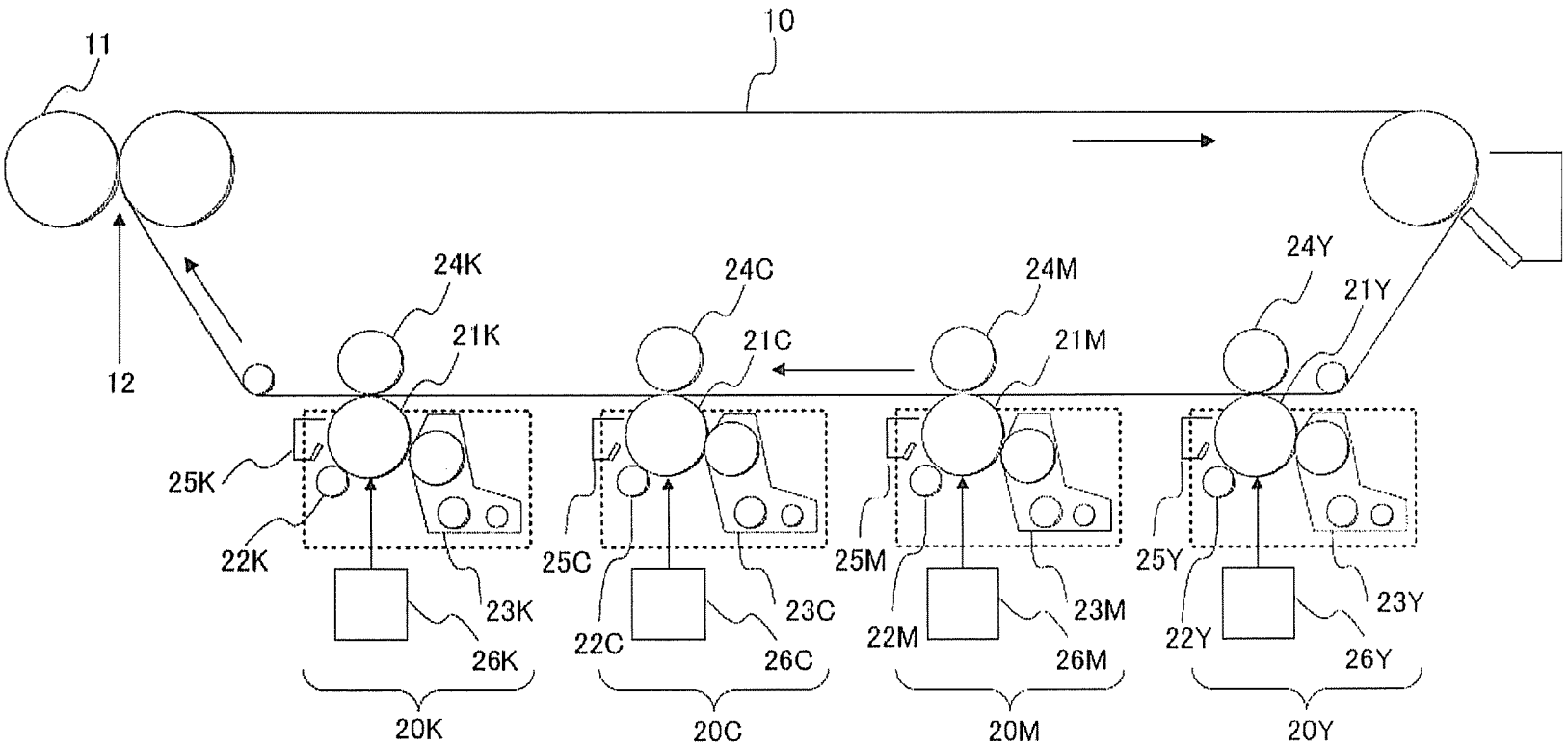
FIG. 1 is a structure view of an image forming apparatus of an embodiment.

FIG. 1 is a structure view of an image forming apparatus of a four-drum tandem color printer, which is an example of an image forming apparatus of an embodiment. As shown in FIG. 1, a secondary transfer roller 11 to transfer an image on an intermediate transfer belt 10 onto a transfer medium 12, and respective image forming units 20Y, 20M, 20C and 20K of yellow, magenta, cyan and black are arranged along the conveyance direction (arrow direction) of the intermediate transfer belt 10.

The image forming units 20Y, 20M, 20C and 20K include photoreceptors 21Y, 21M, 21C and 21K as image carriers. Further, charging devices 22Y, 22M, 22C and 22K as charging portions, developing devices 23Y, 23M, 23C and 23K including developing rollers as developing members and having developers including color toner particles of yellow, magenta, cyan and black and carrier particles, primary transfer rollers 24Y, 24M, 24C and 24K as transfer portions, and cleaner units 25Y, 25M, 25C and 25K are provided around the respective photoreceptors. These are respectively arranged along the rotation directions of the corresponding photoreceptors 21Y, 21M, 21C and 21K.

The primary transfer rollers 24Y, 24M, 24C and 24K are disposed inside an intermediate transfer belt 10, and nip the intermediate transfer belt 10 against the corresponding photoreceptors 21Y, 21M, 21C and 21K. Exposure devices 26Y, 26M, 26C and 26K are arranged so that exposure points are formed on the outer peripheral surfaces of the photoreceptors 21Y, 21M, 21C and 21K between the charging devices 22Y, 22M, 22C and 22K and the developing devices 23Y, 23M, 23C and 23K. The secondary transfer roller 11 is arranged outside the intermediate transfer belt 10 so as to contact therewith.

A print operation is performed as described below by the image forming apparatus constructed as stated above. A toner image is formed in the image forming unit 20Y. The same process is performed also in the image forming units 20M, 20C and 20K in synchronization with the timing of the toner image formation in the image forming unit 20Y. The toner images of magenta, cyan and black formed on the photoreceptors of the image forming units 20M, 20C and 20K are also sequentially primarily transferred onto the intermediate transfer belt 10.

The transfer medium 12 is conveyed from a cassette (not shown), and is sent to the intermediate transfer belt 10 by an aligning roller (not shown) in timing with the toner images on the intermediate transfer belt 10.

A bias (+) of a reverse polarity to a charging polarity of a toner is applied to the secondary transfer roller 11 by a power source (not shown). As a result, the toner images on the intermediate transfer belt 10 are transferred onto the transfer medium P by a transfer electric field formed between the intermediate transfer belt 10 and the secondary transfer roller 11. A fixing device (not shown) to fix the toner transferred onto the transfer medium 12 is disposed, and the transfer medium 12 is made to pass through the fixing device so that a fixed image is obtained.

Incidentally, although the description is made on the example in which the image forming units are arranged in color sequence of yellow, magenta, cyan and black, the color sequence is not limited.

Figure 2:
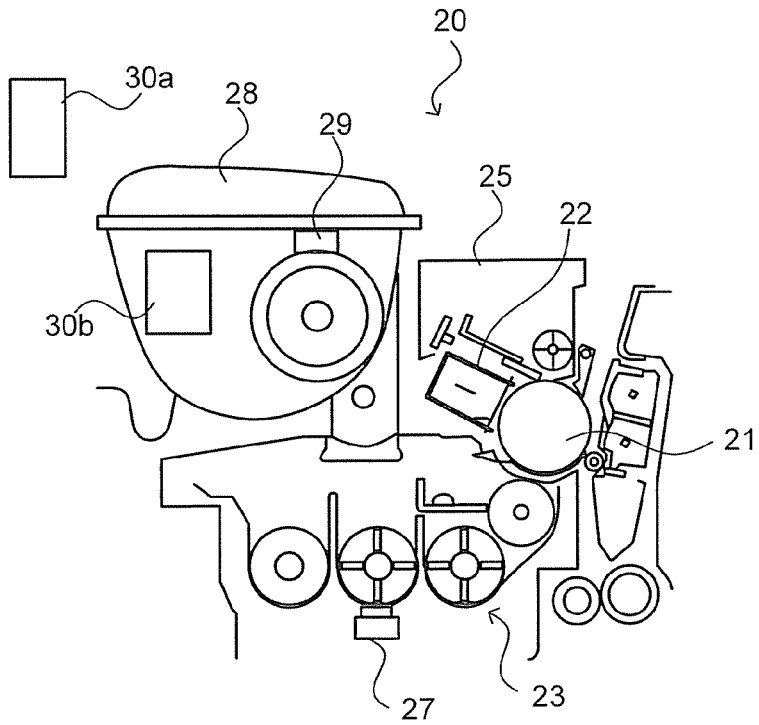
FIG. 2 is a schematic structural view of the image forming unit in the image forming apparatus shows of the embodiment.

FIG. 2 is a schematic structural view of the image forming unit 20 in the image forming apparatus, which is constructed as stated above and in which an image is formed. The image forming units 20Y, 20M, 20C and 20K have also the same structure as the image forming unit 20.

As shown in FIG. 2, the charging device 22, the developing device 23 and the cleaning unit 25 and a like, are arranged around the photoreceptor 21. A toner remaining amount sensor 27, such as a toner density sensor, to detect the toner remaining amount of a developer contained in the developing device 23 is installed in the developing device 23, a toner cartridge 28 is mounted, and a toner cartridge drive time counter 29 is installed. Incidentally, although the toner cartridge drive time counter 29 is provided, no limitation is made to the drive time counter, and any mechanism may be used as long as a value based on a use amount of toner, such as the number of prints, output pixels or the number of rotations of the toner cartridge, can be detected and the use amount of toner can be estimated.

Further, memories 30*a* and 30*b* to store toner empty information and the like are respectively provided in the body of the image forming unit 20 and the toner cartridge 28. The respective components of the image forming unit are connected to a control operation system (not shown) to control and operate these.

Figure 3:
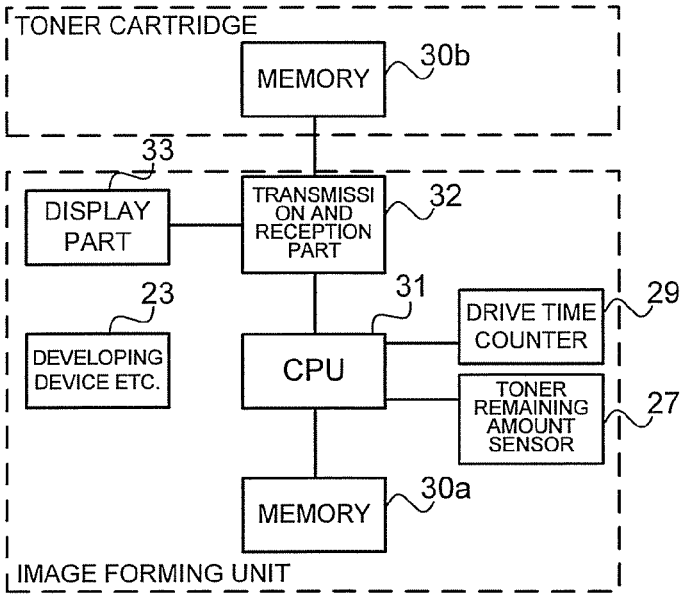
FIG. 3 is a block diagram of a structure portion in which the control of the forcible toner supply operation is performed shows of the embodiment.

In the image forming unit as stated above, control of a forcible toner supply operation is performed as described below. FIG. 3 is a block diagram of a structure portion in which the control of the forcible toner supply operation is performed. As shown in FIG. 3, a CPU 31 as a control operation system is connected to the memory 30*a* of the body of the image forming unit 20, the toner remaining amount sensor 27 and the drive time counter 29.

Further, the CPU 31 operates the image forming apparatus including the image forming unit 20 through a transmission and reception part 32 via wired or wireless communication, and is connected to a display part 33 which displays a message of near empty state, toner cartridge replacement, print stop or the like according to the request of the CPU 31 and based on the state of the body of the image forming unit 20, the memory 30*b* of the toner cartridge 28, and the respective equipments, such as the developing device 23, in the image forming apparatus 20.

FIG. 4 shows a correspondence table of an address and information content in the memory 30*a* at the body side, and FIG. 5 shows a correspondence table of an address and information content in the memory 30*b* at the toner cartridge side.

As shown in the table of FIG. 4, the memory 30*a* at the body side includes, for each address, an area (A001) to which an identification code is inputted, an area (A002) to which a near empty threshold and a like from the memory 30*b* at the toner cartridge 28 side is written, and an area (A003) of a counter value from the drive time counter 29.

As shown in the table of FIG. 5, a previously set near empty threshold (B002), together with an identification code (B001), is inputted to the memory 30*b* at the toner cartridge 27 side for each address. Incidentally, the near empty threshold may be inputted as cartridge information, and the CPU 31 may calculate the near empty threshold based on that.

Further, there are provided an area (B003) to which a drive time counter value from the memory 30*a* at the body side is written, an area (B004) to which first empty information estimated by the CPU 31 based on the counter value from the drive time counter 29 is written, an area (B005) to which second empty information detected by the toner remaining amount sensor 27 is written, and an area (B006) to which third empty information in the developing device 23 detected by the toner remaining amount sensor 27 is written.

Figure 6:
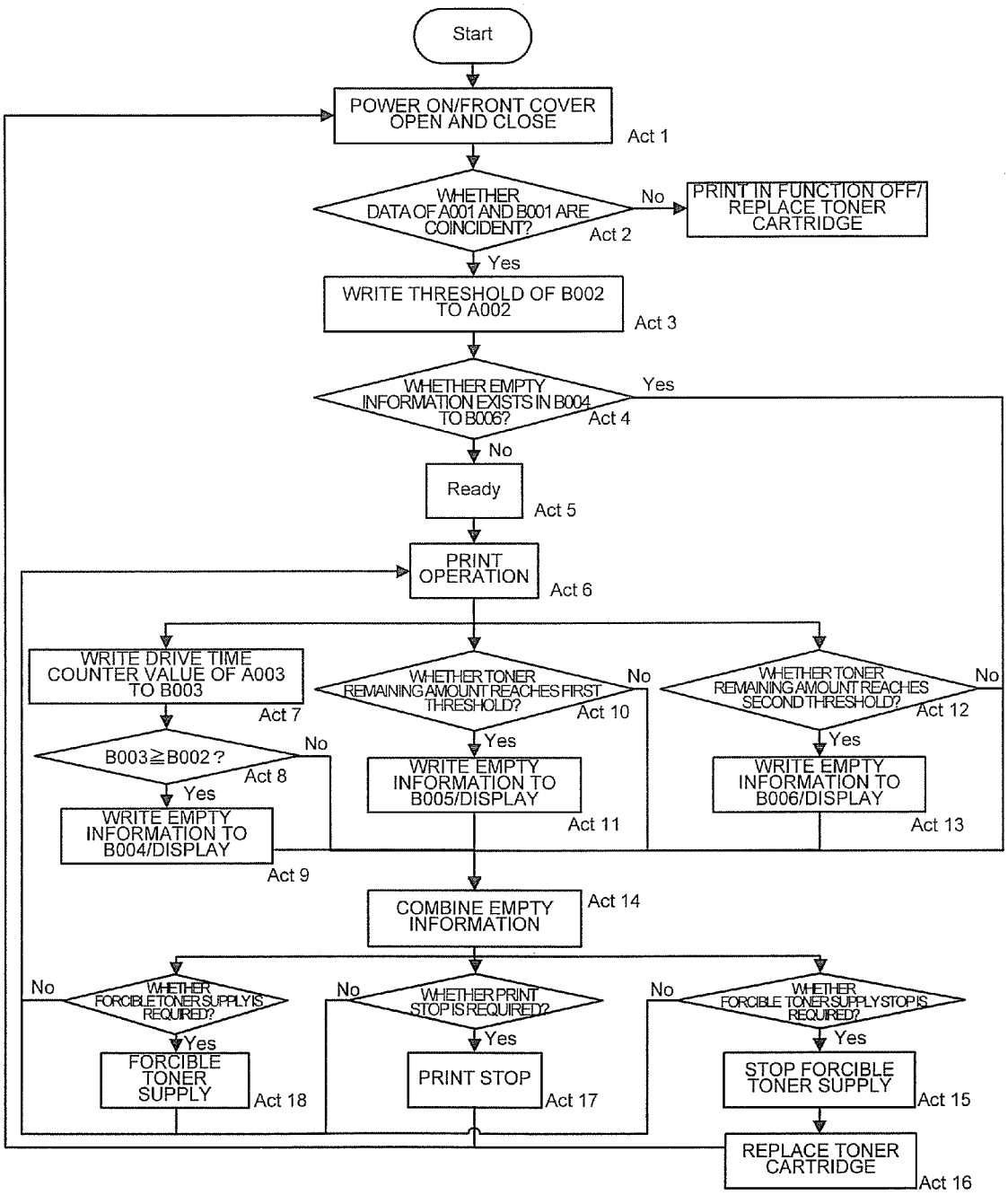
FIG. 6 is a flowchart of a forcible toner supply operation of the embodiment.

By the structure as stated above, the control of the forcible toner supply operation is performed as described below. FIG. 6 is a flowchart. As shown in FIG. 6, power is turned ON at the start of printing, or a front cover is opened and closed to replace a toner cartridge or the like (Act 1). The identification codes inputted to A001 of the memory 30*a* and B001 of the memory 30*b* are checked against each other (Act 2), and when they are coincident, the following operation is performed. When they are not coincident, a print operation in which the function of the embodiment is turned OFF is performed, or the toner cartridge is replaced.

The near empty threshold information of B002 is written to A002 (Act 3). Empty information of B006 to B008 is confirmed (Act 4), and when empty information is not written, the image forming apparatus body is placed in a ready state (Act 5).

In this state, the print operation is performed as described above (Act 6). After the drive time counter 29 writes a drive time counter value to A003, the value is further written to B003 and is stored (Act 7). The stored value of B003 (A003) is compared with the value of B002 (A002) (Act 8). When the value of B003 (A003) exceeds the value of B002 (A002), first empty information is written to B004 and is stored. The display part 33 displays a message indicating that the remaining toner becomes low (hereinafter referred to as toner near empty sign) (Act 9).

Next, the value detected by the toner remaining amount sensor 27 is compared with, for example, a first threshold based on which it is determined that the toner remaining amount in the developing device 23 is low (Act 10). When the detected value exceeds the first threshold (the toner remaining amount is lower than that at the first threshold), second empty information is written to B005 and is stored. Further, the display part 33 displays a message indicating that toner is to be replaced (hereinafter referred to as toner replacement sign) (Act 11).

Further, the value detected by the toner remaining amount sensor 27 is compared with a second threshold based on which it is determined that the toner remaining amount is lower than that at the first threshold and the toner remaining amount in the developing device 23 is, for example, almost zero (Act 12). When the detected value exceeds the second threshold (the toner remaining amount is lower than that at the second threshold), third empty information is written to B006 and the toner replacement sign is displayed (Act 13).

These pieces of empty information written to B004 to B006 in this way are combined, and the necessity of a forcible toner supply operation stop and a printer stop (necessity of an operation stop) is determined as described below (Act 14). Until now, the necessity of a forcible toner supply operation is determined based on only the toner remaining amount sensor 26 (B005, B006). However, in this embodiment, the first empty information based on the drive time counter value is added and the determination is performed, and therefore, an erroneous operation can be prevented.

FIG. 7 shows a correspondence table of the combination pattern of the first to the third empty information (B004 to B006), the message on the display part 33 and the operation of the image forming apparatus. As shown in FIG. 7, when the first near empty information (B004) exists, the near empty sign is displayed (Act 9). When at least one of the second and the third near empty information (B005, B006) exists, the toner replacement sign is displayed (Act 11, 13).

Further, when the first near empty information (B004) exists, and when at least one of the second and the third near empty information (B005, B006) exists, the forcible toner supply operation is stopped (Act 15), and the toner cartridge is replaced (Act 16). When the third empty information (B006) exists, the display part 33 displays a message indicating that the print operation is stopped and the print operation is stopped in order to prevent an image defect, such as carrier attachment, from occurring (Act 17). When the first near empty information does not exist (B004), the forcible toner supply is performed (Act 18).

FIG. 8 shows the state of each of the image forming units in the four-drum tandem color printer and the operation of the image forming apparatus. When the print operation is stopped in the image forming unit of one of yellow, magenta and cyan (the states of No. 7 and No. 8 in FIG. 7), the print operation in a color mode is stopped.

At this time, when the print operation is not stopped in the black image forming unit, the print operation in a monochrome mode is not stopped. When the print operation is stopped in the black image forming unit, the print operation in the monochrome mode is stopped.

As described above, since the erroneous operation of the forcible toner supply operation can be suppressed, the waiting time of a user can be shortened. Further, since the unnecessary supply operation is not performed, the drive time (running distance) of the photoreceptor can be reduced, and the life of the photoreceptor can be increased.

Further, based on these pieces of toner empty information, the order information of supply of a toner cartridge can be transmitted, or a second and a third toner supply devices are provided and can be activated. Based on these pieces of toner empty information, at least one of an image processing parameter and an image forming condition is controlled to suppress toner consumption, and the life of the toner cartridge can be lengthened. Further, alarm print can also be performed based on these pieces of toner empty information.

While certain embodiments have been described, these embodiments have been presented by way of example only, and are not intended to limit the scope of the inventions. Indeed, the novel embodiments described herein may be embodied in a variety of other forms; furthermore, various omission, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming method, comprising:

supplying toner from a toner cartridge to a developing device to perform a predetermined print operation in an image forming unit;

detecting a parameter value for obtaining a use amount of the toner;

storing first empty information when the parameter value reaches a previously inputted threshold of the parameter indicating a near empty state;

storing second empty information when a toner remaining amount in the developing device reaches a first toner remaining amount;

storing third empty information when the toner remaining amount in the developing device reaches a second toner remaining amount closer to an empty state than the first toner remaining amount; and determining necessity of a forcible toner supply operation based on the respectively stored first to third empty information.

2. The method of claim 1, wherein necessity of print stop in the image forming unit is determined based on at least the first and the third empty information.

3. The method of claim 1, wherein in each of the image forming units of yellow, magenta, cyan and black, necessity of print stop in the image forming unit is determined based on at least the first and the third empty information, and when it is determined that the print stop is unnecessary in the image forming unit of the black, the print operation in a monochrome mode is executed irrespective of determination of the print stop in at least one of the image forming units of the yellow, the magenta and the cyan.

4. The method of claim 1, wherein the threshold of the parameter, and the first to the third empty information are stored in a first memory provided in the toner cartridge.

5. The method of claim 1, wherein an identification code is inputted in each of a first memory provided in the toner cartridge and a second memory provided in the image forming unit, and the respective identification codes are checked against each other.

6. The method of claim 1, wherein the first toner remaining amount and the second toner remaining amount are detected with toner density.

7. The method of claim 1, wherein the parameter value is at least one of a drive time of the toner cartridge, the number of prints, output pixels and the number of rotations.

8. The method of claim 1, wherein when the first empty information is stored, a near empty message is displayed.

9. The method of claim 1, wherein when the second empty information is stored, toner cartridge replacement is displayed.

10. The method of claim 1, wherein when the third empty information is stored, a message of toner cartridge replacement is displayed.

* * * * *